United States Patent [19]

Milburn, Jr.

[11] Patent Number: 4,466,335

[45] Date of Patent: Aug. 21, 1984

[54] SEALING FOR VARIABLE VOLUME DEVICE

[75] Inventor: William W. Milburn, Jr., Boulder, Colo.

[73] Assignee: Milburn Stirling Corporation, Boulder, Colo.

[21] Appl. No.: 322,502

[22] Filed: Nov. 18, 1981

[51] Int. Cl.[3] ..... F01B 7/20; F01L 33/02

[52] U.S. Cl. ..... 91/173; 91/180; 92/178; 92/193; 92/249; 417/517; 417/534

[58] Field of Search ..... 417/534, 517, 463, 468; 91/173, 180; 92/178, 193, 249, 177, 125; 277/216, 219, 220, 221

[56] References Cited

U.S. PATENT DOCUMENTS

| | | | |
|---|---|---|---|
| 1,410,129 | 3/1922 | Saussord | 417/468 |
| 1,868,935 | 7/1932 | Breneman | 92/178 |
| 2,013,862 | 9/1935 | Schulz et al. | 417/463 |
| 2,258,397 | 10/1941 | Estey | 91/173 |
| 2,363,119 | 11/1944 | Crossman | 417/517 |
| 2,495,445 | 1/1950 | Crenshaw | 91/173 |
| 2,574,921 | 11/1951 | Johnson | 417/463 |
| 3,631,765 | 1/1972 | Neumeister | 92/178 |

FOREIGN PATENT DOCUMENTS

| | | | |
|---|---|---|---|
| 726482 | 10/1942 | Fed. Rep. of Germany | 92/178 |
| Ad.55074 | 12/1950 | France | 92/178 |
| 1102636 | 3/1953 | France | 92/277 |

*Primary Examiner*—Paul E. Maslousky

*Attorney, Agent, or Firm*—O'Rourke & Harris

[57] ABSTRACT

An improvement for a variable volume device in the form of a rectilinear case having disposed therein a rectilinear outer piston structure and a rectilinear inner piston structure within the outer piston structure, the inner piston being carried for rotation on a crank shaft and in turn inducing a reciprocal movement of the outer piston structure in the case, the improvement comprising rollers positioned between the outer piston structure and the case, and the inner piston structure and outer piston structure to facilatate thrust and force accomodation therebetween, and sealing strip means positioned in sealing relationship between the outer piston structure and rectilinear case, and inner piston structure and outer piston structure, and particularly an embodiment in which the sealing strips means of the inner piston structure bear against the side portion of the outer piston structure sealing ring means and a bearing plate positioned to support the rollers, whereby the rectilinear innerrunning pistons may be effectively and reliably mounted for relative motion ensealed to define variable volume portions in the device.

13 Claims, 16 Drawing Figures

SEALING FOR VARIABLE VOLUME DEVICE

BACKGROUND OF THE INVENTION

This invention relates to sealing of a variable volume device formed of rectlinear pistons and casing, the sealing utilizing rollers and sealing strips to separate force transfer and sealing functions.

Variable volume devices utilizable as pneumatic or fluid motors, compressors, internal or external combustion engines, etc. are known in many variations and configurations. Particularly in positive displacement embodiments, the use of a reciprocating piston fitted in a cylinder and sealed by means of rings extending circumferentially around the piston is well known in the art. Other arrangements having apparent advantages in the mechanical configuration thereof, such as the Wankel rotary engine, have been found to suffer at least initially critical draw backs in the sealing between the static and moving components. Simplicity of the cylindrical piston ring in many respects offset the additional volume, production expense, weight, etc. of the ubiquitous piston and cylinder arrangement.

One previously proposed particularly advantageous design for a variable volume apparatus, apparently a century old Root's design, utilizes a rectilinear casing containing a pair of rectilinear pistons therein. An outer piston is reciprocated within the casing to define variable volumes at either end thereof. The inner piston reciprocates relative to the outer piston in a direction transverse to the direction of reciprocation of the outer piston in a relative sense, and rotates in an absolute sense, to provide third and fourth variable volumes between the inner and outer pistons. Examples of such structures are to be found in U.S. Pat. No. 2,013,862 and British Patent No. 479,705, issued to Skarlund. The advantages of light weight relative to displacement, compactness, simplicity of parts, etc. of such a design are readily apparent. However, despite these advantages, no widely accepted utilization of such design has resulted. As with other designs utilizing linear or flat surfaces bearing upon flat surfaces, it would appear that the lack of practical application is attributable to the difficulty of sealing such devices. Also, in contrast to the situation with a reciprocating cylindrical piston in which the greatest forces are transverse to the direction of sealing, the rectangular piston arrangement particularly involves substantial forces at the sealing area between the inner and outer pistons thus substantially complicating the task of providing effective and efficient sealing therebetween.

SUMMARY OF THE INVENTION

The instant invention provides a variable volume device utilizing interrunning rectangular pistons disposed within a rectangular case in which the substantial forces are accomodated by rollers interposed between the casing and piston, and piston and piston, for movement on bearing plates, which the sealing strips analogous to more conventional piston rings are positioned between such components, and in the case of the inner piston, ride upon the bearing plate and outer piston sealing strips side wall. By providing resilient members behind the sealing strips, both sealing around and between the components is provided while concurrently providing compliance of the sealing members to compensate for wear and minute variations in dimensions during reciprocation of the pistons.

Thus the outer piston may be carried on rollers preferably positioned inboard of the sealing interface and between the outer piston and casing. A more complicated but similar sealing requirement is met by providing at the interface between the inner and outer pistons. The inner piston is movable relative to the outer piston again on rollers inboard of the sealing area, but the inner piston includes sealing strips biassed outward which bear upon both the bearing plate portions of the outer piston and the sidewalls of the outer pistons sealing strips to avoid paths in which fluid may escape when compressed between the inner and outer piston. To best accomplish this, the outer piston sealing strips are positioned in a plane common with the outer surface of the bearing plates and the inner piston sealing strips bear upon the planes defined by the sidewall of the outer piston sealing strips and the bearing plates. The lower outer piston sealing strips are preferably notched to about the bearing plates which serve in part as lands for the outer pistons sealing strips both to locate and seal the outer piston sealing strip.

DESCRIPTION OF THE DRAWINGS

The above-mentioned and other features of this invention and the preferred means for providing such advantages will become apparent, and the invention itself will be best understood, by reference to the following description of the embodiments of the mention taken in conjunction with the accompanied drawings, the description of which follows.

DESCRIPTION OF THE PREFERRED EMBODIMENT

Figure 1:
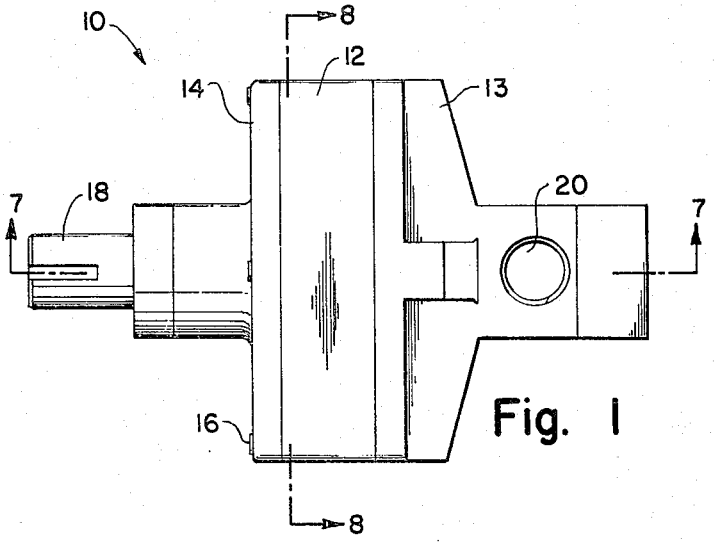
FIG. 1 is a top view of the variable volume device in accord with the instant invention.
Figure 2:
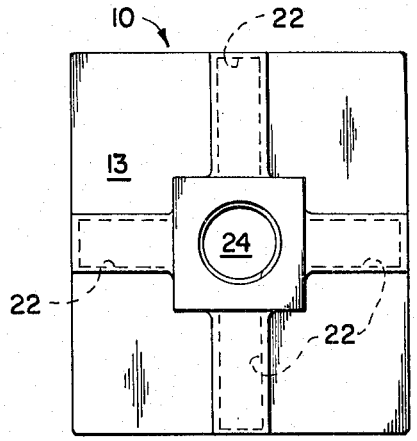
FIG. 2 is an end view illustrating in ghosted fashions certain of the supporting of the variable volume device as shown in FIG. 1.

Turning now to the drawings, wherein like components are designated by like reference numerals throughout the various figures which may relate to similar but differing embodiments, a variable volume device is illustrated in FIGS. 1 and 2, particularly in the form of an air motor, and generally designated by the reference numeral 10. Variable volume device 10 includes a hollow rectangular central case 12, end member 13 attached on one side thereof, and output end member 14 secured to central case 12 and end member 13 by fasteners 16. Crank shaft 18, which is journaled within central case 12 and end members 13 and 14, extends beyond output end member 14. Inlet port 20 is defined in end member 13 to provide, in the particular embodiment illustrated, air pressurized volumes as will be discussed in more detail below. Air inlet port 20 is connected in timed relationship relative to rotation of crank shaft 18 to four port runners 22, as shown in FIG. 2. Exhaust outlet 24 is provided at one end of end member 13.

Figure 5:
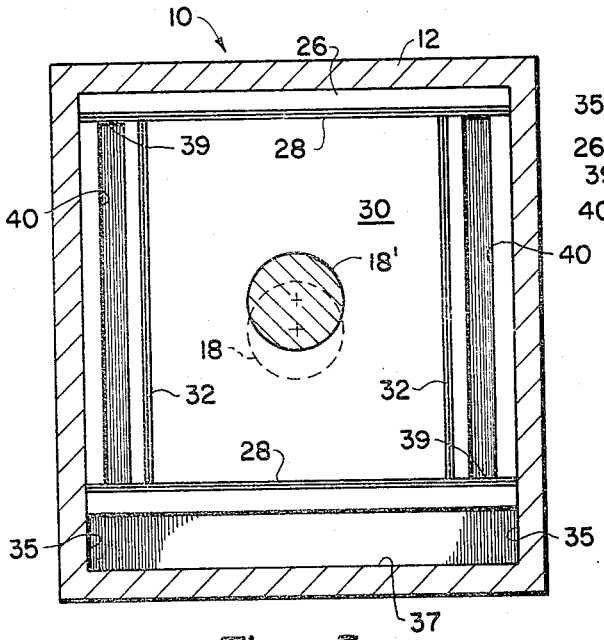
Figure 6:
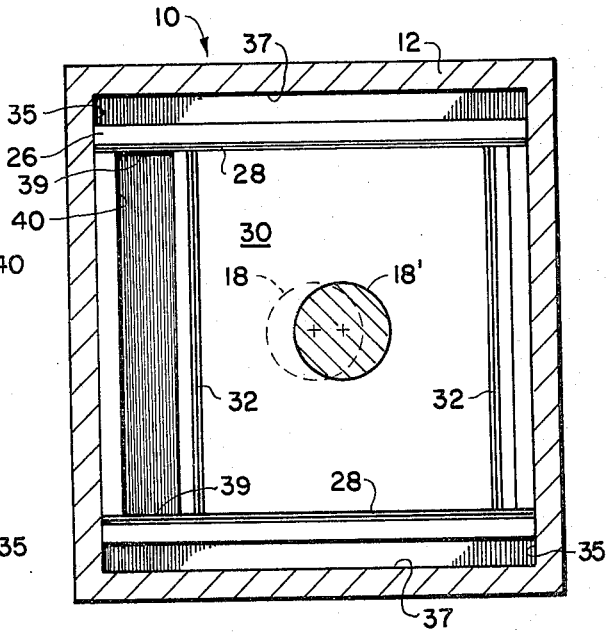

With reference to FIGS. 3 through 6, it will be noted that central case 12 is hollow and includes therein an outer piston assembly 26, and sealing strips 28 carried thereon to bear upon casing side wall 35. Inner piston assembly 30 is supported internally of outer piston assembly 26 and includes inner piston assembly sealing strips 32 which in turn seal between outer piston assembly 26 and inner piston assembly 30. Inner piston assembly 30 is carried for rotation on the eccentric 18′ of crank shaft 18 as illustrated. Thus as eccentric 18′ is rotated, starting with FIG. 3 the lower volume between central case 12 and outer piston assembly 26 is fully compressed, while in FIG. 4 the variable volume between inner piston assembly 30 and outer piston assembly 26 is, at the left hand portion of the figure, fully compressed. In sequence, as shown in FIGS. 5 and 6, similar compression of the variable volumes at opposite ends occurred in the same sequence upon full rotation. Thus, casing end walls 37 define opposed variable volumes, while outer piston assembly end walls 40 similarly define the extremes of another pair of opposed variable volumes. As will be defined in more detail below, it should be noted that outer piston assembly inner walls 39 which are defined in part by outer piston assembly sealing strip 28, forms a surface upon which a portion of inner piston assembly 30 sealing strip 32 bears. Thus, as shown in a simplified manner FIGS. 3 through 6 illustrate how four distinct volumes vary from fully expanded to fully compressed during one complete rotation of crank shaft 18, as well as illustrating the basic sealing relationship.

Figure 7:
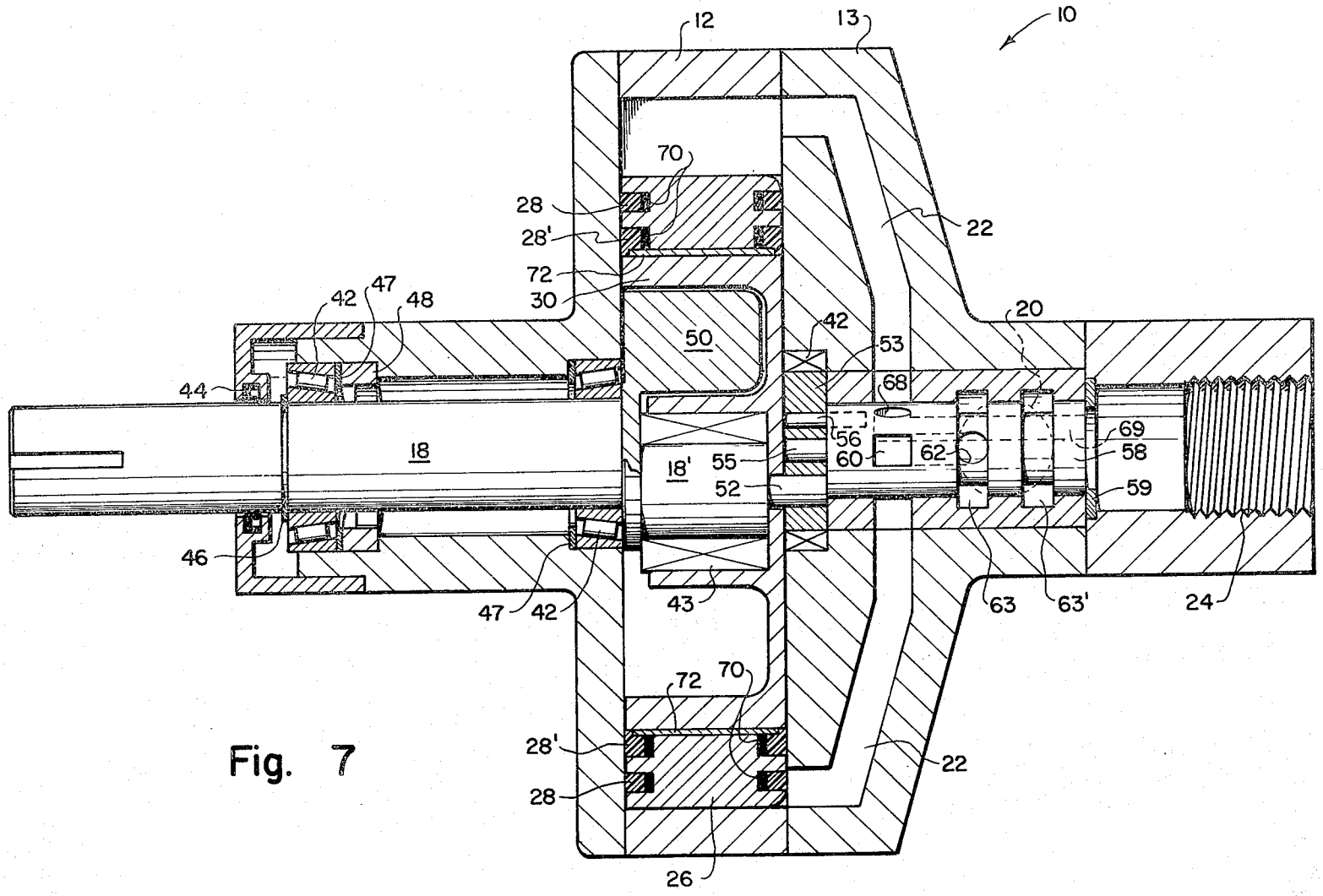
FIG. 7 is a sectional view of the variable volume device along section line 7—7 of FIG. 1.

Referring now to FIG. 7, it will be noted that crank shaft 18 is supported in central case 12 and output end member 14 by bearings 42. Seal 44 provides for sealing rotation between crank shaft 18 and end member 14. Snap ring 46 carried upon crank shaft 18 provides for outboard axial location of crank shaft 18, with wave washers 47 providing resilient thrust positioning, particularly with outboard wave washer 47 bearing against support 48 at spaced intervals therearound. Counter weight 50 of crank shaft 18 also provides a thrust face for axial location. Pin 52, extending between crank shaft eccentric 18′ and drive ring 53 permits rotation of drive ring 53 within bearing 42. Support rod 55 and drive pin 56 provide for rotation of valve body 58, carried in end member 13. In such manner, valve body 58 will rotate concentric with and concurrent with crank shaft 18. Thrust ring 59 is provided to maintain valve body 58 within end member 13. Though conventional and not forming the unique part of the invention, the function of valve body 58 will be addressed in but a simplified manner.

As shown, intake port openings 60 defined in the surface of valve body 58 communicates through axial port 61 with intake port orifice 62 which in turn is in communication with annular orifice 63 connected with air inlet port 20 shown in FIG. 1. Thus, when valve body 58 rotates such that intake port opening 60 aligns with one of the four port runners 22, an external source of fluid under pressure will communicate with port runners 22, and according with the interior of a variable volume. In a similar manner, and of course in proper timed relationship, exhaust port 68 defined in valve body 58 will rotate into communication with the appropriate port runner 22, and thus permit exhaust through axial channel 69 communicating with exhaust outlet 24, illustrated in a threaded manner in contemplation of use of a muffler (not shown). If desired, a second annular opening 63′ may be provided which, with appropriate valving (not shown), will provide for conventional reversing of variable volume device 10 when run as an air motor.

Turning now to the internal piston arrangements illustrated in FIG. 7, it will be seen that outer piston assembly 26 utilizes resilient members 70, which in the case of an air motor are preferrably in the form of a rubber insert, but under more demanding conditions could include wave springs or similar biassing means, are provided behind dual sealing strips 28 and 28′. Sealing strips 28 and 28′ are for the most part similar, but as will be described below, sealing strip 28′ is particularly configured to accomodate bearing plate 72.

Figure 8:
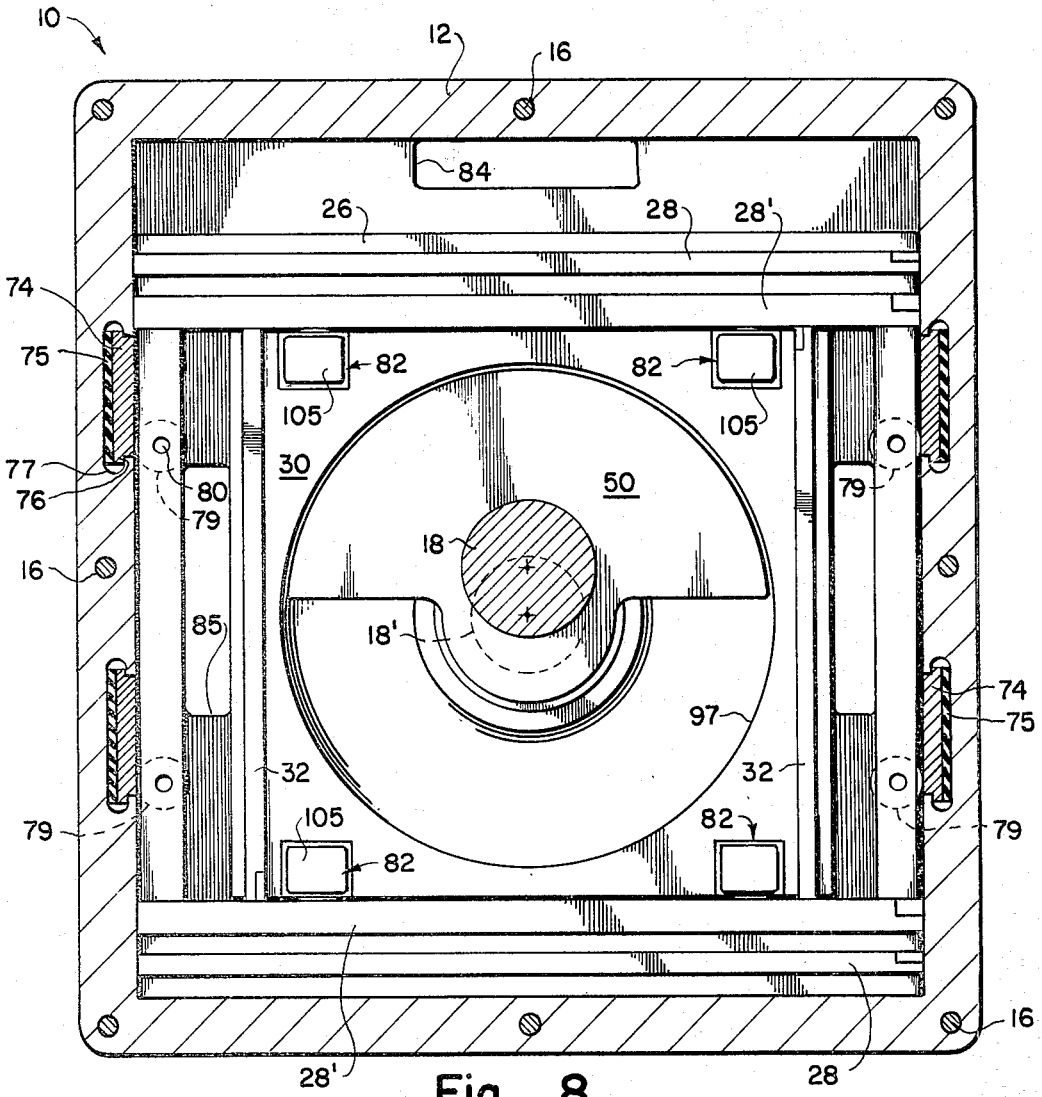
FIG. 8 is a sectional view along section line 8—8 of FIG. 1.
Figure 3:
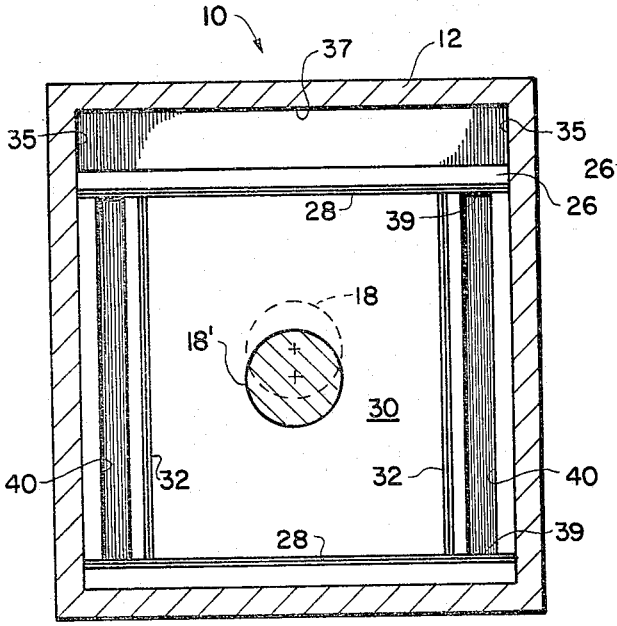
FIGS. 3–6 are simplified, sectional views of a variable volume device in accord with the instant invention particularly illustrating the volumes which may be varied, and the relationship of inner and outer piston assembly sealing strips.
Figure 4:
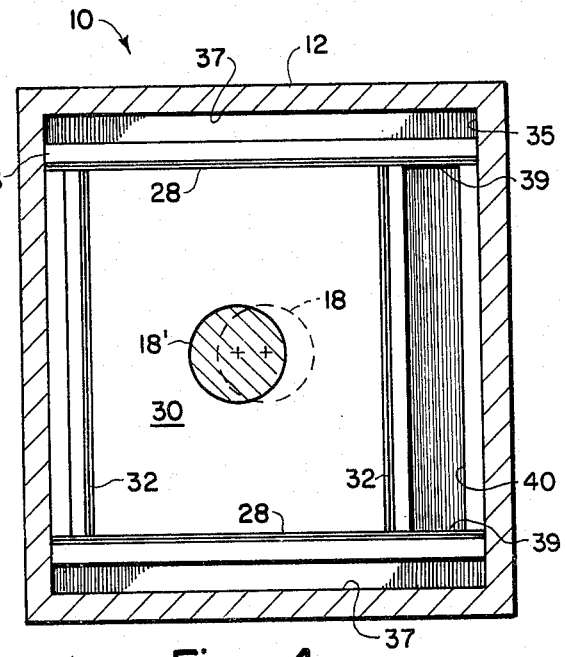

With reference to FIG. 8, it will be seen that outer piston assembly 26 is positioned within central case 12 at case bearing plates 74, which in turn are resiliently supported by member 75 interposed between case 12 and plate 74, and located within case 12 by undercuts 76 defined in case 12 into which projections 77 of bearing plates 74 extend. Outer rollers 79, supported by roller pins 80 tightly fitted in outer piston assembly 26, are positioned to bear upon bearing plates 74.

In the particular illustration of FIG. 8, outer piston assembly 26 is in the full "down" portion of the stroke, and it is to be noted that lower sealing strips 28′ do not interfere with bearing plate 74, while rollers 79 are positioned to bear upon bearing plates 74. Accordingly, appropriate inboard mounting of rollers 79 in inner piston assembly 26 is preferred. At inner piston assembly 30, roller assemblies 82, which will be discussed in more detail below, are positioned to support inner piston assembly 30 within outer piston assembly 26. Outer port openings 84 and inner port openings 85, each of which communicates with a port runner 22, provides for intake and exhaust of fluid, such as air in the manner described above.

Figure 9:
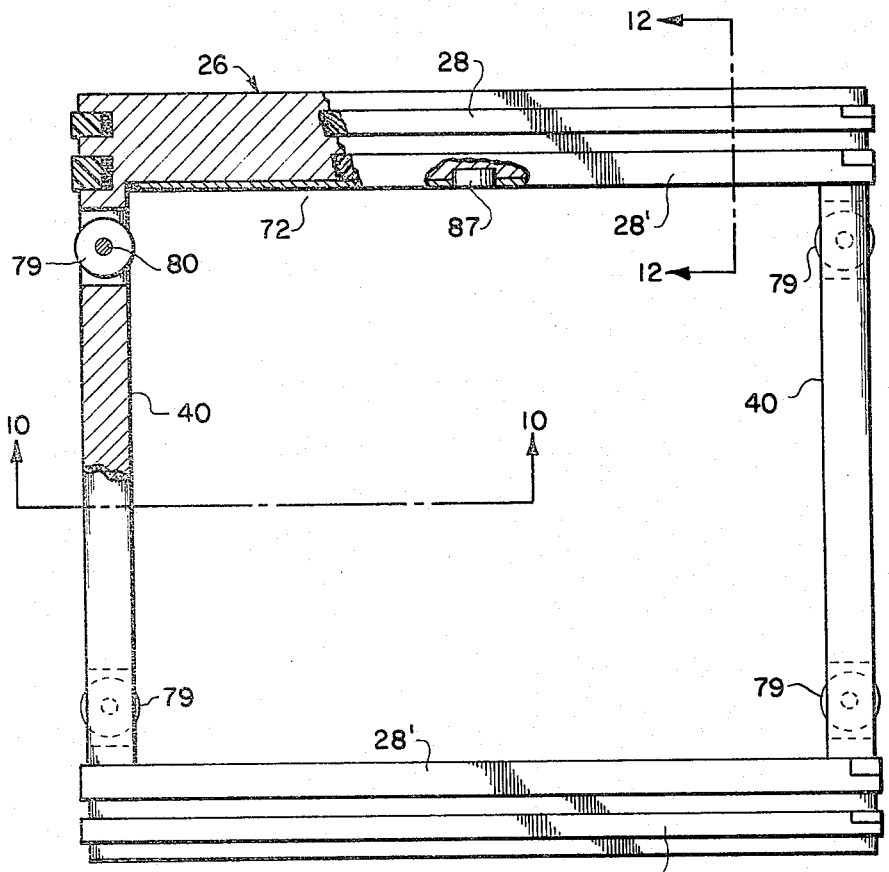
FIG. 9 is a partially broken away section view of an outer piston assembly as utilized in the instant invention.
Figure 10:
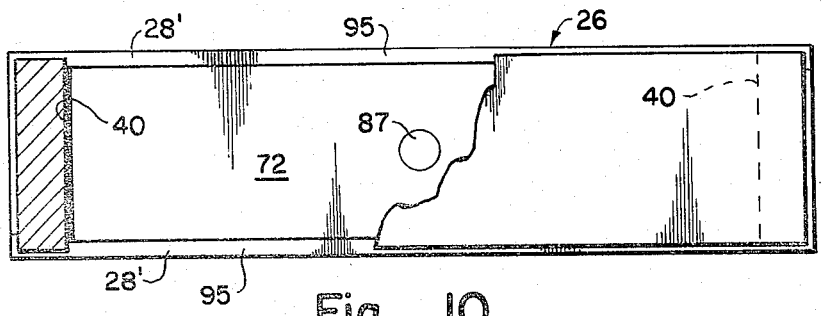
FIG. 10 is a partially broken away bottom view of the outer piston assembly of FIG. 1.
Figure 11:
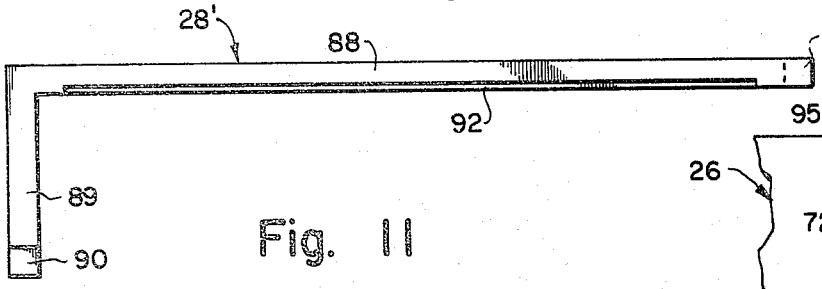
FIG. 11 is a detailed view of a particular sealing strip in accord with the instant invention.
Figure 12:
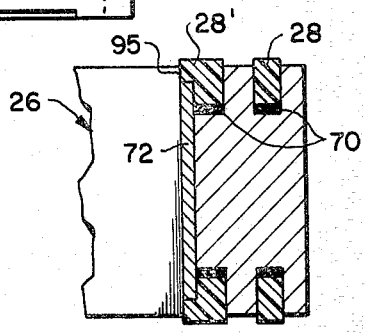
FIG. 12 is a partial section view along line 12—12 of the outer piston assembly in FIG. 9.

Turning now to FIG. 9, the structure of outer piston assembly 26 will be discussed in more detail. As shown, projection 87 is provided to locate bearing plate 72 relative to outer piston assembly 26. As is shown in particular detail in FIGS. 10, 1 and 12, the relationship between lower sealing strips 28′ and bearing plate 72 constitute an important aspect of the invention. Sealing strip 28′ includes an elongated portion 88, a shorter end portion 89 configured at right angles to elongated portion 88, and opposing notches 90 and 91 at the ends thereof. Accordingly, two segments which are shown in FIG. 11 may be fitted together to form a full rectangular sealing strip with fitted notches 90 and 91 of each strip forming a pair of sealing interfaces. As shown in the drawings, the two L-shaped segments of the sealing strips are of a thickness appropriate to fit in the respective groove in the inner and outer pistons with each L-shaped segment being slightly less than the corresponding dimension of the piston on the inner portion and slightly more than such dimension of the piston on the outer portion of the segment, each of the segments having complimentary notches on opposed sides of the ends thereof, whereby two sealing strip segments may be fitted together to fit within the piston at the groove and extend beyond the piston to bear a sealing relationship with the adjacent wall, with the opposed notches fitting together to form a substantially gas type interface. Indent 92 is defined along the inner side of elongated portion 88 and, is shown particularly well in FIG. 12, sealing strip 28' receives bearing plate 72 such that side face 95 of sealing strip 29 and bearing plate 72 form a flat surface adapted to receive in sealing relationship sealing strip 32 of inner piston assembly 30. Resilient members 70 positioned under sealing strips 28' will both urge sealing strip 28' outward into contact with the wall of case 12, seal behind sealing strip 28' to prevent gas leakage, and provide in a preferred embodiment, a sealing relationship between bearing plate 72 and sealing strip 28'.

Figure 13:
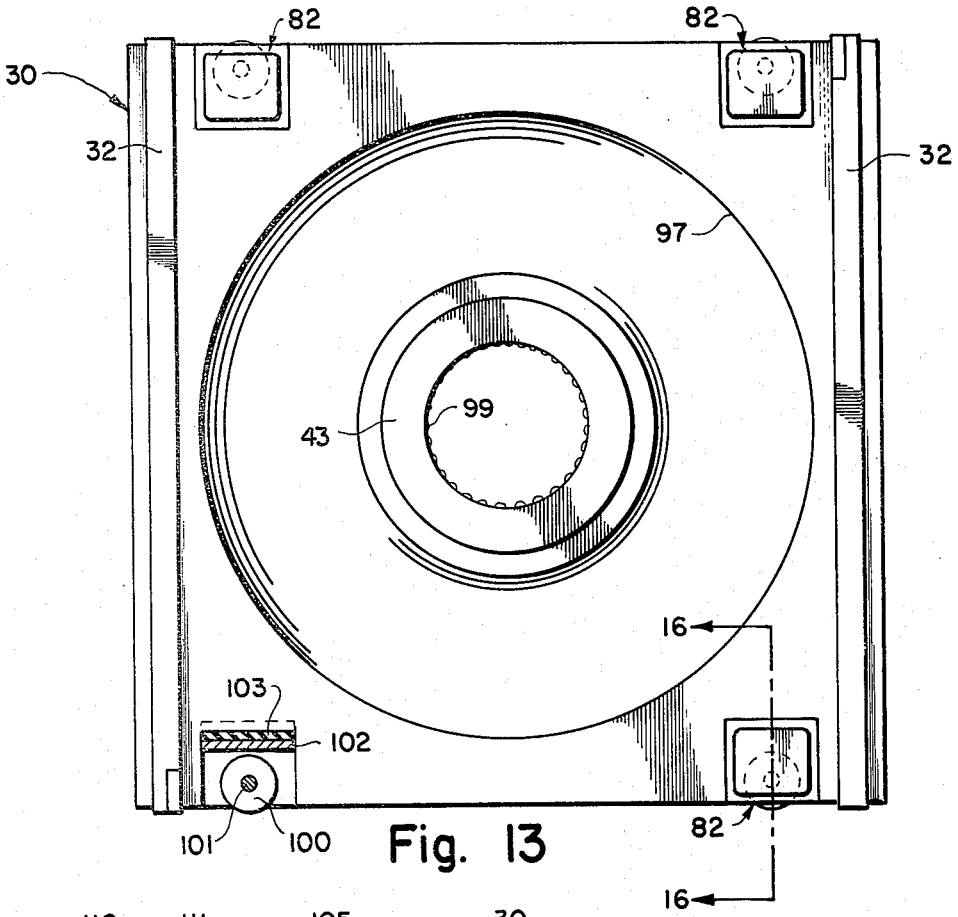
FIG. 13 is a side view of an inner piston assembly in accord with the instant invention.

Turning now to FIG. 13, it will be seen that inner piston assembly 30 includes an internal cylindrical relief defined by wall 97 to permit rotation of counter weight 50 therein. It is preferred that counter weight 50 be aerodynamically configured to avoid unneccessary drag. Roller bearings 99 are provided within inner piston assembly 30 to provide low friction movement relative to crank eccentric 18'. As shown in the cut-away portion of inner piston assembly 30, roller assembly 82 includes a roller 100, forwarded on axle 101, which in turn is rotatably carried on yoke assembly 102, described in more detail below, and urged outward by biassing means 103, preferrably a rubber insert, but again operably by a wave spring or other biassing means.

Figure 14:
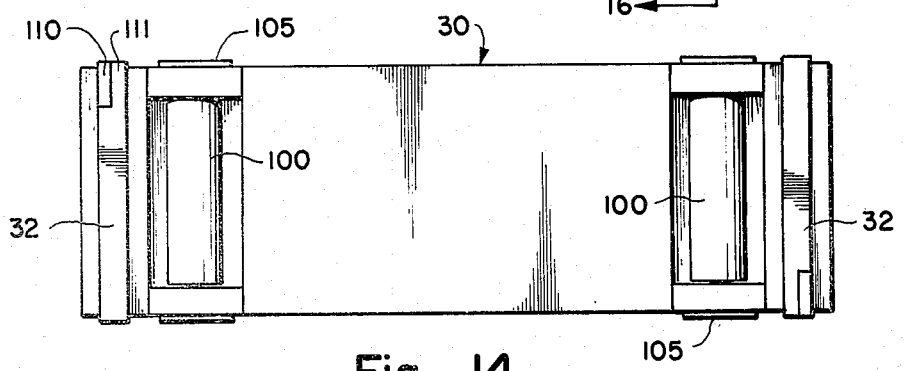
FIG. 14 is a bottom view of the inner piston assembly of FIG. 13.
Figure 16:
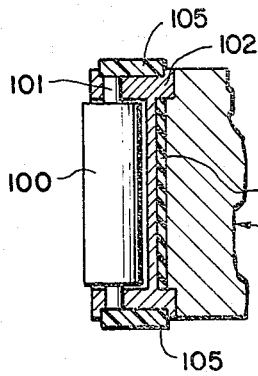
FIG. 16 is a partial section view along line 16—16 of a portion of the inner piston assembly in FIG. 13.
Figure 15:
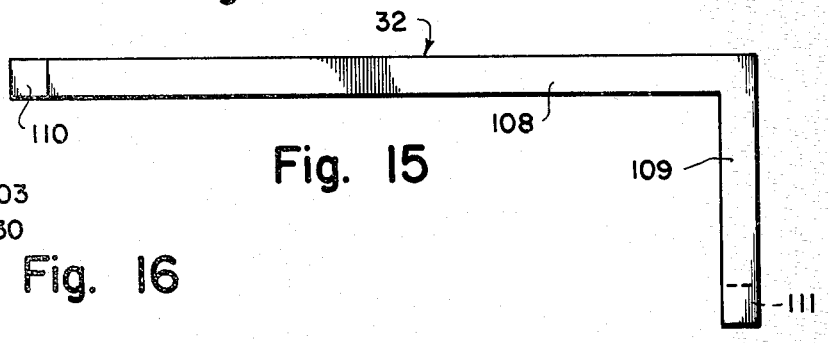
FIG. 15 is a detailed view of an inner piston sealing strip.

Further details of inner piston assembly 30 are shown in FIGS. 14, 15 and 16. At the outer portion of roller assembly 82, locating pads 100 of hard, low friction material are provided to position inner piston assembly 30 within case 12, and end portions 13 and 14. As shown in FIG. 15, sealing strip 32, which is substantially identical except for size to sealing strip 28, includes an elongated portion 108, a shorter portion 109 extending at right angles from elongated portion 108, and notches 110 and 111 on opposite sides thereof. Thus two sealing strip 32 segments as illustrated in FIG. 15 are again fitted together as described above with notches 110 and 111 forming two sealing connections.

In summary, movement of the inner and outer rectilinear pistons is accomodated in a low friction, positive manner by rollers as described above, and sealing strips are provided not to carry the various forces, but merely to prevent fluid leakage from the variable volume portion of the device. In general, it is preferred that the movable portion of the apparatus, particularly the inner and outer piston assemblies, be primarily formed of a light weight material such as aluminum.

Portions may be drilled and sealloped for weight reductions, but if this is done in a volume between the valve body and variable volume, the removed portion should be filled with a less dense material to minimize open volumes. The bearing plates are preferrably of hardened steel, as are the rollers, to provide a wear resistant, low friction interface. In devices operating under modest temperature and pressure conditions, such as air motors, as illustrated, or compressors, the biassing means behind the sealing strip and bearing plate is preferrably of a cross-link polymer. Under higher temperatures metal biassing means, such as wave springs would advantageously be employed. Locating and sealing means, such as the pads on the sides of the inner piston assembly, and all of the sealing strips, are preferrably formed of filled polytetralfluoro olefins. Delrin filled with teflon is a particularly preferred material for this function.

Although only limited embodiments have been illustrated and described, it is anticipated that various changes in modifications will be apparent to those skilled in the art, and that such changes may be made without departing from the scope of the invention that defined by the following claims.

What is claimed is:

1. In a variable volume device comprising an outer case defining a substantially closed six sided rectilinear chamber, an outer piston having an inner rectilinear opening disposed in the rectilinear chamber and mounted for reciprocal movement in a first direction to define two variable volumes, an inner piston disposed within the outer piston opening and mounted for reciprocal movement in a second direction transverse to the first direction to define two variable volumes, an eccentric member journaled relative to the case and mounted through the inner piston to produce a rotary motion of the inner piston and a relative reciprocal motion of the inner piston within the outer piston and the outer piston within the case, and valve means to selectively open and close fluid channels to the volumes defined between the outer piston and case, and inner piston and outer piston, the improvement comprising positioning rotatable mounted rollers between the outer case and the sides of the outer piston and between the inner piston and outer piston at the sides of each piston parallel to the direction of reciprocation of the piston, the rollers being journaled on axes parallel to the axis of rotation of the eccentric, the inner and outer pistons having grooves defined around the perimeter thereof adjacent to but spaced from each end of the piston forming a major side of the variable volume with sealing strips being carried in such grooves and in sealing relationships between the piston and the adjacent surface, and with the sealing strips each comprising two L-shaped segments of a thickness apporpriate to fit in the respective groove with said L-shaped segments, when fitted together, having a resulting circumference slightly less than the corresponding dimension of the piston on the inner portion thereof and slightly more than such dimension of the piston on the outer portion of the segments, each of the segments having complimentary notches on opposed sides of the ends thereof, whereby two sealing strip segments may be fitted together to fit within the piston at the groove and extend beyond the piston to bear a sealing relationship with the adjacent wall, with the opposed notches fitting together to form a substantially gas tight interface.

2. An improvement to a variable volume device as set forth in claim 1 in which a bearing plate is positioned in the wall opposite each roller, the bearing plate extends a distance at least equal to the reciprocation stroke of the adjacent roller, and is positioned to support the roller throughout the reciprocal movement.

3. An improvement to a variable volume device as set forth in claim 1 in which resilient inserts are positioned behind each of the sealing strips at the bottom portion of the groove to urge the sealing strip into contact with the adjacent surface.

4. An improvement to a variable volume device as set forth in claim 3 in which the resilient inserts are of an elastomeric polymer composition and serve to both seal the void behind the sealing strip and the groove and urge the sealing strip outward.

5. An improvement to a variable volume device as set forth in claim 1 in which a bearing plate is positioned immediately adjacent each sealing strip and extending from the sealing strip at one major dimension of the outer piston to the same sealing strip at the opposed major side of the outer piston, each bearing plate being adapted to receive and support the inner piston rollers at one side thereof.

6. In a variable volume device comprising an outer case defining a substantially closed six sided rectilinear chamber, an outer piston having an inner rectilinear opening disposed in the rectilinear chamber and mounted for reciprocal movement in a first direction to define two variable volumes, an inner piston disposed within the outer piston opening and mounted for reciprocal movement in a second direction transverse to the first direction to define two variable volumes, an eccentric member journaled relative to the case and mounted through the inner piston to produce a rotary motion of the inner piston and a relative reciprocal motion of the inner piston within the outer piston and the outer piston within the case, and valve means to selectively open and close fluid channels to the volumes defined between the outer piston and case, and inner piston and outer piston, the improvement comprising positioning rotatably mounted rollers between the outer case and the sides of the outer piston and between the inner piston and outer piston at the sides of each piston parallel to the direction of reciprocation of the piston, the rollers being journaled on axes parallel to the axis of rotation of the eccentric, and in which at least two grooves are defined around the perimeter of the outer piston at locations spaced inward from each portion thereof defining a major side of the variable volume, with sealing strips disposed within each groove and forming a sealing relationship between the outer piston and adjacent casing wall, a bearing plate being positioned immediately adjacent each sealing strip and extending from the sealing strip at one major dimension of the outer piston to the same sealing strip at the opposed major side of the outer piston, each bearing plate being adapted to receive and support the inner piston rollers at one side thereof, the side portions of each outer piston sealing strips having defined therein a recess to receive the corresponding bearing plate, and the inner piston having defined therein at least two grooves each of which carries a sealing ring, the grooves of the inner piston being positioned substantially transverse to the grooves of the outer piston and having the sealing ring bearing in part upon the bearing plate and in part upon the side walls of the outer piston sealing strips adjacent the recesses.

7. In an interrunning rectangular piston variable volume device comprising an outer case defining a substantially closed six sided rectilinear chamber, an outer piston having an inner rectilinear opening disposed in the rectilinear chamber and mounted for reciprocal movement in a first direction to define two opposed variable volumes, an inner piston disposed within the outer piston opening and mounted for reciprocal movement in a second direction transverse to the first direction to define two additional opposed variable volumes, a crankshaft journaled relative to the case and mounted to the inner piston to produce a rotary motion of each point on the inner piston, a relative reciprocal motion of the inner piston within the outer piston and of the outer piston within the case, and valve means to selectively open and close fluid channels communicating with the volumes defined between the outer piston and case, and inner piston and outer piston, the improvement comprising positioning rotatably mounted rollers between the outer case and the sides of the outer piston and between the inner piston and outer piston at the sides of each piston parallel to the direction of reciprocation of the piston, the rollers being journaled on axes parallel to the axis of rotation of the crankshaft, and sealing means positioned between each piston and adjacent sidewall at locations between a roller and the closest end of such side of the piston, the sealing means extending around the perimeter of the piston, and having a bearing plate positioned in the wall opposite each roller, the bearing plate extending a distance at least equal to the reciprocation stroke of the adjacent roller and positioned to support the roller throughout the reciprocal movement but terminating short of the portion of the opposite wall engaged by the sealing means, the bearing plates being positioned in the case in recesses defined in the case and urged outward towards the adjacent roller by biassing means positioned between the bearing plate and the case.

8. An improvement to a variable volume device as set forth in claim 7 in which the inner and outer pistons have grooves defined around the perimeter thereof adjacent to but spaced from each end of the piston forming a major side of the variable volume, and the sealing means are in the form of sealing strips carried in such grooves and in sealing relationships between the piston and the adjacent surface.

9. An improvement to a variable volume device as set forth in claim 8 in which resilient inserts are positioned behind each of the sealing strips at the bottom portion of the groove to urge the sealing strip into contact with the adjacent surface.

10. An improvement to a variable volume device as set forth in claim 9 in which the resilient inserts are of an elastomeric polymer composition and serve to both seal the void behind the sealing strip and the groove and urge the sealing strip outward.

11. In an interrunning rectangular piston variable volume device comprising an outer case defining a substantially closed six sided rectilinear chamber, an outer piston having an inner rectilinear opening disposed in the rectilinear chamber and mounted for reciprocal movement in a first direction to define two opposed variable volume, an inner piston disposed within the outer piston opening and mounted for reciprocal movement in a second direction transverse to the first direction to define two additional opposed variable volumes, a crankshaft journaled relative to the case and mounted to the inner piston to produce a rotary motion of each point on the inner piston, a relative reciprocal motion of the inner piston within the outer piston and of the outer piston within the case, and valve means to selectively open and close fluid channels communicating with the volumes defined between the outer piston and case, and inner piston and outer piston, the improvement comprising positioning rotatably mounted rollers between the outer case and the sides of the outer piston and between the inner piston and outer piston at the sides of each piston parallel to the direction of reciprocation of the piston, the rollers being journaled on axes parallel to the axis of rotation of the crankshaft, and sealing means positioned between each piston and adjacent side wall at locations between a roller and the closest end of such side of the piston, the sealing means extending around the perimeter of the piston, and having a bearing plate positioned in the wall opposite each roller, the bearing plate extending a distance at least equal to the reciprocation stroke of the adjacent roller and positioned to support the roller throughout the reciprocal movement but terminating short of the portion of the opposite wall engaged by the sealing means, the inner and outer pistons having grooves defined around the perimeter thereof adjacent to but spaced from each end of the piston forming a major side of the variable volume, and the sealing means being in the form of sealing strips carried in such grooves and in sealing relationships between the piston and the adjacent surface, and which sealing strips each comprise two L-shaped segments of a thickness appropriate to fit in the respective groove with said L-shaped segments, when fitted together, having a resultant circumference slightly less than the corresponding dimension of the piston on the inner portion thereof and slightly more than such dimension of the piston on the outer portion of the segments, each of the segments having complimentary notches on opposed sides of the ends thereof, whereby two sealing strip segments may be fitted together to fit within the piston at the groove and extend beyond the pistons to bear a sealing relationship with the adjacent wall, with the opposed notches fitting together to form a substantially gas tight interface.

12. An improvement to a variable volume device as set forth in claim 11 in which at least two of the grooves are defined around the perimeter of the outer piston at locations spaced inward from each portion thereof defining a major side of the variable volume, and inward of other sealing means, sealing strips disposed within each such groove and forming a sealing relationship between the outer piston and adjacent casing wall, a bearing plate positioned immediately adjacent each sealing strip and extending between the sides of the sealing strip in a plane defined by the edge of the sealing strip closest to the inner piston, each bearing plate being adapted to engage and support the rollers at one side of the inner piston.

13. An improvement to a variable volume device as set forth in claim 12 in which the side portions of each of the outer piston sealing strips in a common plane with the bearing plate have defined therein a recess to receive the corresponding bearing plate, and the inner piston has defined therein at least two grooves each of which carry a sealing ring, the grooves of the inner piston being positioned substantially transverse to the grooves of the outer piston and having the sealing ring bearing upon a sealing surface defined in part by the bearing plates and in part by the side walls of the outer piston sealing strips adjacent the recesses.

* * * * *